US008612239B2

(12) United States Patent
Lee et al.

(10) Patent No.: US 8,612,239 B2
(45) Date of Patent: Dec. 17, 2013

(54) APPARATUS AND METHOD FOR CODING AUDIO DATA BASED ON INPUT SIGNAL DISTRIBUTION CHARACTERISTICS OF EACH CHANNEL

(75) Inventors: Mi-Suk Lee, Daejon (KR); Do-Young Kim, Daejon (KR); Hae-Won Jung, Daejon (KR)

(73) Assignee: Electronics & Telecommunications Research Institute, Daejeon (KR)

( * ) Notice: Subject to any disclaimer, the term of this patent is extended or adjusted under 35 U.S.C. 154(b) by 1087 days.

(21) Appl. No.: 12/518,263

(22) PCT Filed: Dec. 7, 2007

(86) PCT No.: PCT/KR2007/006357

§ 371 (c)(1), (2), (4) Date: Jun. 8, 2009

(87) PCT Pub. No.: WO2008/069614

PCT Pub. Date: Jun. 12, 2008

(65) Prior Publication Data

US 2010/0153119 A1 Jun. 17, 2010

(30) Foreign Application Priority Data

Dec. 8, 2006 (KR) ..... 10-2006-0124468

(51) Int. Cl.
*G10L 21/00* (2013.01)

(52) U.S. Cl.
USPC ..... 704/500; 342/17; 348/631; 363/65; 375/130; 375/343; 381/103; 381/11; 381/18; 381/20; 381/22; 381/66; 381/79; 700/94; 704/216; 704/22; 704/268

(58) Field of Classification Search
USPC ..... 381/18, 20, 103, 11, 22, 66, 79; 342/17; 348/631; 363/65; 375/130, 343; 700/94; 704/216, 222, 268, 500
See application file for complete search history.

(56) References Cited

U.S. PATENT DOCUMENTS 5,077,603 A * 12/1991 Macovski ..... 348/631
5,323,486 A * 6/1994 Taniguchi et al. ..... 704/222

(Continued)

FOREIGN PATENT DOCUMENTS

JP 2004-325633 11/2004
JP 2005-202248 7/2005

(Continued)

OTHER PUBLICATIONS

Jonas Lindblom, et al., "Flexible Sum-Difference Stereo Coding Based on Time-Aligned Signal Components," 2005 IEEE Workshop on Applications of Signal Processing to Audio and Acoustics (Oct. 16-19, 2005, New Paltz, NY), pp. 255-258.

(Continued)

*Primary Examiner* — Michael Colucci
(74) *Attorney, Agent, or Firm* — Staas & Halsey LLP

(57) ABSTRACT

Provided is an audio coding apparatus and method that can selectively apply a operation mode of a coding module for stereo or multi-channel representation according to input signal characteristics of each channel, when voice or music signals are transmitted using an audio codec in portable terminals capable of stereo or multi-channel input and output. The audio coding apparatus includes a down-mixer for down-mixing multi-channel audio signals into mono signals; a coder for coding the mono signals; an input channel correlation analyzer for deciding whether to give them stereo effect based on their signal distribution characteristics, and outputting a control signal indicating whether to perform stereo representation process; and a stereo representation unit for performing stereo representation process onto the multi-channel audio signals when the control signal indicating to perform stereo representation process.

4 Claims, 2 Drawing Sheets

(56) References Cited

U.S. PATENT DOCUMENTS

| | | | | |
|---|---|---|---|---|
| 5,544,278 | A * | 8/1996 | Bialik et al. | 704/268 |
| 5,655,025 | A * | 8/1997 | Kim et al. | 381/11 |
| 6,005,948 | A * | 12/1999 | Maeda | 381/18 |
| 6,275,589 | B1 * | 8/2001 | Spille | 381/22 |
| 6,519,344 | B1 * | 2/2003 | Yajima et al. | 381/103 |
| 6,741,483 | B1 * | 5/2004 | Stanley | 363/65 |
| 6,789,059 | B2 * | 9/2004 | Kandhadai et al. | 704/216 |
| 6,867,726 | B1 * | 3/2005 | Yu et al. | 342/17 |
| 6,885,900 | B1 * | 4/2005 | Rybicki et al. | 700/94 |
| 7,647,129 | B1 * | 1/2010 | Griffin, Jr. | 700/94 |
| 8,009,718 | B2 * | 8/2011 | Sugiura et al. | 375/130 |
| 2004/0190726 | A1 * | 9/2004 | Imadate | 381/11 |
| 2004/0223622 | A1 * | 11/2004 | Lindemann et al. | 381/79 |
| 2005/0078773 | A1 * | 4/2005 | Astrachan | 375/343 |
| 2005/0141594 | A1 * | 6/2005 | Smith et al. | 375/130 |
| 2006/0133618 | A1 * | 6/2006 | Villemoes et al. | 381/20 |
| 2006/0293902 | A1 * | 12/2006 | Kim et al. | 704/500 |
| 2007/0208565 | A1 * | 9/2007 | Lakaniemi et al. | 704/268 |
| 2008/0101622 | A1 * | 5/2008 | Sugiyama | 381/66 |

FOREIGN PATENT DOCUMENTS

| | | |
|---|---|---|
| KR | 10-2006-0049980 | 5/2006 |
| KR | 10-0651833 | 11/2006 |

OTHER PUBLICATIONS

International Search Report (Form PCT/ISA/210) for International Application No. PCT/KR2007/006357, mailed Feb. 14, 2008.

* cited by examiner

APPARATUS AND METHOD FOR CODING AUDIO DATA BASED ON INPUT SIGNAL DISTRIBUTION CHARACTERISTICS OF EACH CHANNEL

CROSS REFERENCE TO RELATED PATENT APPLICATIONS

This application claims the benefit under 35 U.S.C. Section 371, of PCT International Application No. PCT/KR2007/006357, filed Dec. 7, 2007, which claimed priority to Korean Application No. 10-2006-0124468, filed Dec. 8, 2006 in the Korean Intellectual Property Office, the disclosures of which are hereby incorporated by reference.

TECHNICAL FIELD

The present invention relates to an apparatus and method for audio coding reflecting signal distribution characteristics of each channel; and, more particularly, to an audio coding apparatus and method that can selectively apply a operation mode of a coding module for stereo or multi-channel representation according to input signal characteristics of each channel, when voice or music signals are transmitted using an audio codec in portable terminals capable of stereo or multi-channel input and output.

This work was supported by the IT R&D program of MIC/IITA [2006-S-100-02, "Development of Multi-codec and Its Control Technology Providing Variable Bandwidth Scalability"].

BACKGROUND ART

Audio codecs process signals inputted from one or more channels. Generally, when there is one input channel and one output channel, signals are referred to as mono signals. When there are two input channels and two output channels, signals are referred to as stereo signals. When the number of input channels and output channels are more than two, signals are called as multi-channel signals. In stereo signal coding, if signals of each channel are coded independently, then the bit-rate for transmission becomes high. But, the bit-rate can be reduced by using a stereo coding algorithm. Examples of audio coding for processing stereo signals, which will be referred to as stereo coding, include intensity stereo coding, Mid/Side (M/S) stereo coding, and parametric stereo coding.

The intensity stereo coding has been used since Moving Picture Experts Group (MPEG-1). According to psychoacoustic analysis results, stereo signals of over 2 kHz frequency are perceived not by fine structure of audio signals but by size information in a time domain. Therefore, the intensity stereo coding method transmits scale factor of right and left channel signals and sum signals of the right and left channel signals to maintain sound shape and reduce the bit rate, instead of coding and transmitting right channel signals and left channel signals, individually.

According to M/S stereo coding, the sum and subtraction of normalized right and left signals are transmitted instead of the right and left signals being transmitted. The M/S stereo coding can adjust short time delay between the right channel and the left channel, control the sound shape, and acquire a little bit of signal processing gain. The adjustable time delay is limited. However, since the time delay is longer than a time delay acoustically perceived by human beings, most of the poor sound shape problems can be resolved.

In case of parametric stereo coding, right channel signals and left channel signals are down-mixed, coded, and transmitted. To represent stereo effect, panorama, ambience, and stereo image such as time and phase difference of stereo channel are made into parameters and transmitted, too. With the parametric stereo coding, stereo signals can be represented with a small number of bits, compared to the M/S stereo coding method.

FIG. 1 shows a block diagram of a typical stereo audio coding apparatus. Referring to FIG. 1, a typical stereo coding scheme does not individually code right channel signals and left channel signals. Instead, signals of the right and left channels are down-mixed in a down-mixer 101 to be converted into mono signals. The mono signals are coded in a coder 102 and transmitted. Meanwhile, parameters are extracted in a stereo representation unit 103 to give signals a stereo effect, and transmitted.

One of the most general down-mixing methods is to sum up signals of right and left channels and divide them into two (which is (R+L)/2). For the stereo representation, scale factors are extracted and transmitted according to the intensity stereo coding method, or the difference between the two signals is coded and transmitted according to the M/S stereo coding method. According to the parametric stereo coding method, various parameters are extracted and transmitted for the stereo representation. The stereo coding has a form of a down-mixing signal coding module provided with a module for extracting stereo representation parameters.

Recently, the number of portable terminals in support of stereo input and output is increasing. The portable terminals are used to transmit not only music signals but also voice signals for conversation between users. However, the stereo effect of voice signals tends to be weaker than that of music signals. Also, since the distance between an input terminal and a speaking user is short in case of portable terminals, there is little difference between right channel signals and left channel signals during voice communication. Thus, users scarcely perceive the difference between stereo and mono. Meanwhile, in case of a portable terminal supplied with power from batteries, the battery lifecycle can be extended by reducing the amount of calculation needed for processing input signals.

Therefore, when the conventional stereo coding method described above is applied to portable terminals mainly used for transmitting/receiving voice signals, the amount of calculation needed for processing input signals increases unnecessarily. This increases power consumption and shortens battery lifecycle.

DISCLOSURE OF INVENTION

Technical Problem

An embodiment of the present invention is directed to providing an audio coding apparatus and method that can reflect signal distribution characteristics of each channel and selectively operate a module needed for stereo or multi-channel representation according to the signal distribution characteristics of each channel.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided an apparatus for coding audio signals based on signal distribution characteristics of each channel, which includes: a down-mixer for receiving multi-channel audio signals and down-mixing the multi-channel audio signals into mono signals; a coder for coding the mono signals; an input channel correlation analyzer for receiving the multi-channel audio signals, deciding whether to give stereo effect to the multi-channel audio signals based on signal distribution characteristics of the multi-channel audio signals for each channel, and outputting a control signal indicating whether to perform stereo representation process; and a stereo representation unit for performing stereo representation process onto the multi-channel audio signals when the control signal indicating to perform stereo representation process.

In accordance with another aspect of the present invention, there is provided a method for coding audio signals based on signal distribution characteristics of each channel, which includes the steps of: receiving multi-channel audio signals; down-mixing the multi-channel audio signals into mono signals; coding the mono signals; and deciding whether to give stereo effect to the multi-channel audio signals based on signal distribution characteristics of each channel.

Advantageous Effects

The present invention described above can reduce calculation amount without deterioration in service quality and thus lengthen lifecycle of batteries by switching on/off the operation of a stereo representation unit for extracting parameters needed for stereo signals representation based on right and left channel signals, when audio signals with little stereo characteristics, such as voice data transmitted during phone call communication, are processed in portable terminals in support of stereo or multi-channel input and output.

MODE FOR THE INVENTION

The advantages, features and aspects of the invention will become apparent from the following description of the embodiments with reference to the accompanying drawings, which is set forth hereinafter. When it is considered that detailed description on a related art may obscure a point of the present invention, the description will not be provided herein. Hereinafter, specific embodiments of the present invention will be described with reference to the accompanying drawings.

Figure 1:
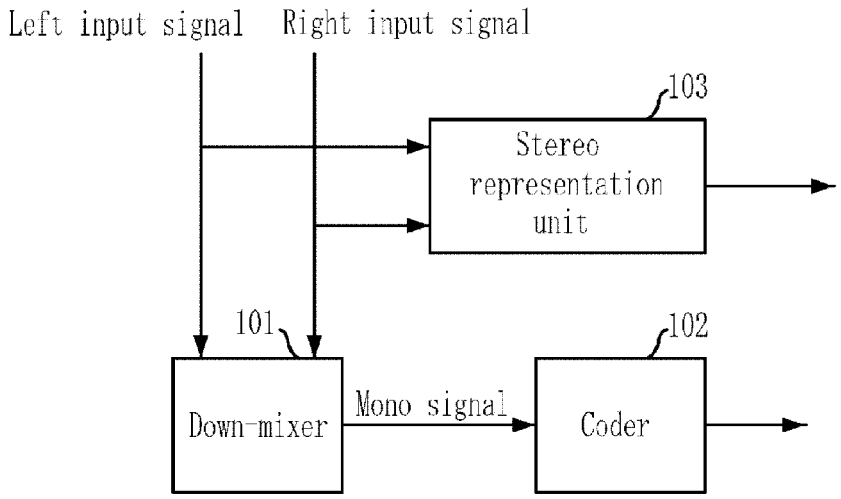
FIG. 1 is a block diagram showing a typical stereo audio coding apparatus.
Figure 2:
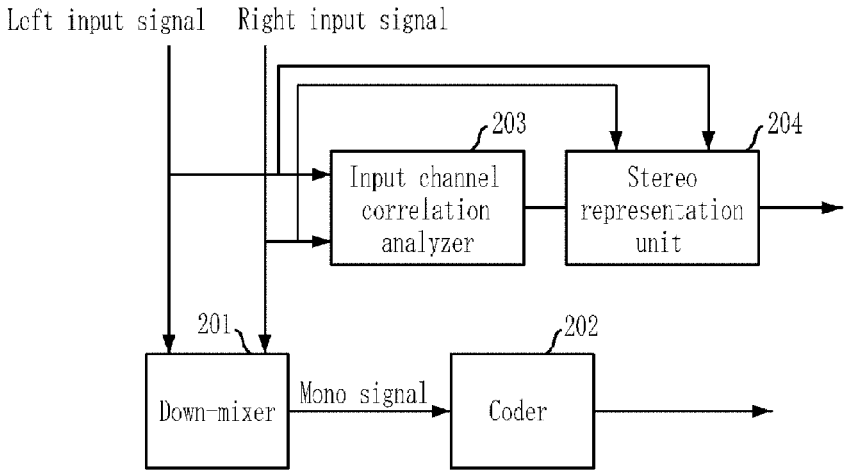
FIG. 2 is a block diagram illustrating a stereo audio coding apparatus reflecting signal distribution characteristics of each channel in accordance with an embodiment of the present invention.

FIG. 2 is a block diagram illustrating a stereo audio coding apparatus reflecting signal distribution characteristics of each channel in accordance with an embodiment of the present invention. Referring to FIG. 2, the stereo audio coding apparatus includes a down-mixer 201, a coder 202, an input channel correlation analyzer 203, and a stereo representation unit 204.

The down-mixer 201 receives input signals of right and left channels, down-mixes them, and outputs mono signals.

The coder 202 receives the mono signals, codes them, and outputs coded mono signals. The coder 202 codes signals down-mixed in a typical audio codec.

The input channel correlation analyzer 203 receives right and left channel input signals, decides whether to operate the stereo representation unit 204 by figuring out signal distribution characteristics of both channel signals, and outputs control signals indicating whether to operate the stereo representation unit 204 or not.

Upon receipt a control signal which indicates to operate the stereo representation unit 204, the stereo representation unit 204 implements stereo representation process onto the right and left channel input signals and outputs stereo parameters. When the control signal indicates not to operate the stereo representation unit 204, the stereo representation unit 204 does not execute the stereo representation process.

Figure 3:
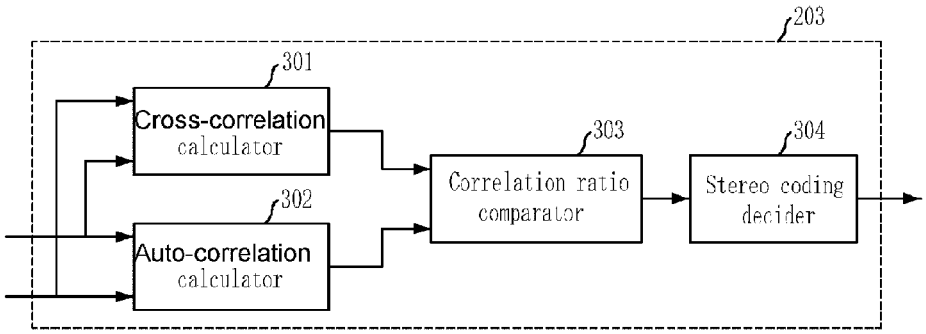
FIG. 3 is a block diagram describing an input channel correlation analyzer of FIG. 2.

FIG. 3 is a block diagram describing an input channel correlation analyzer of FIG. 2. Referring to FIG. 3, the input channel correlation analyzer 203 includes a cross-correlation calculator 301, an auto-correlation calculator 302, a correlation ratio calculator 303, and a stereo coding decider 304.

The auto-correlation calculator 302 calculates auto-correlation for the right and left channel input signals, and the cross-correlation calculator 301 calculates cross-correlation for the right and left channel input signals.

The correlation ratio calculator 303 receives the acquired auto-correlation and cross-correlation, calculates the ratio between the auto-correlation and the cross-correlation and outputs a correlation ratio.

The stereo coding decider 304 receives the correlation ratio, and compares it with a predetermined threshold. When the correlation ratio is smaller than the threshold, it generates and outputs a control signals including information for inactivating the operation of the stereo representation unit 204. Otherwise, it generates and outputs a control signals including information for operating the stereo representation unit 204.

When the right and left channel signals are the same, the auto-correlation and the cross-correlation are the same. In this case, the stereo coding decider 304 outputs a control signal including information for inactivating the operation of the stereo representation unit 204. To sum up, the signal distribution characteristics of the right and left channel signals are analyzed and when the signals of the two channels are similar to each other, the stereo representation unit 204 does not operate. When there is difference between the signals of the two channels, the stereo representation unit 204 operates.

Figure 4:
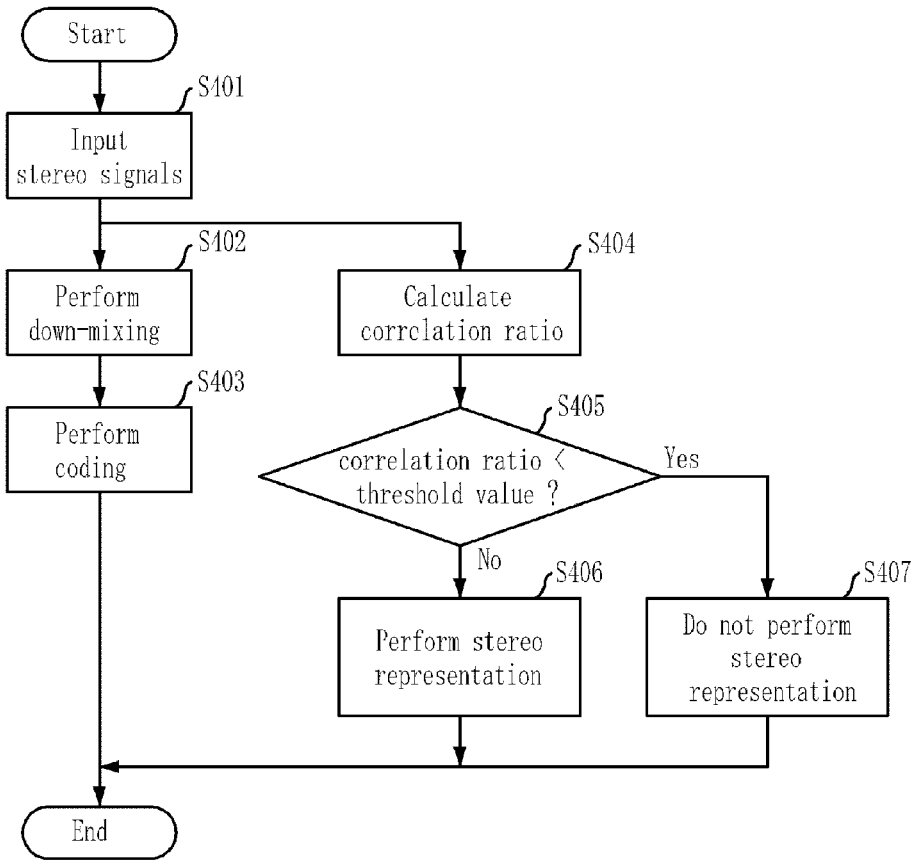
FIG. 4 is a flowchart describing a stereo audio coding process reflecting signal distribution characteristics of each channel in accordance with an embodiment of the present invention.

FIG. 4 is a flowchart describing a stereo audio coding process reflecting signal distribution characteristics of each channel in accordance with an embodiment of the present invention.

At step S401, stereo signals, which are right and left channel signals, are inputted.

At step S402, the inputted stereo signals are down-mixed to be converted into mono signals. At step S403, audio coding parameters are extracted by coding the mono signals based on an audio coding method.

At step S404, the ratio between auto-correlation and cross-correlation for the inputted stereo signals is calculated. At step S405, the correlation ratio is compared with a pre-determined threshold value to decide whether the correlation ratio is smaller than the threshold.

When the correlation ratio is not smaller than the threshold, the stereo representation unit is operated to thereby acquire stereo parameters at step S406. When the correlation ratio is smaller than the threshold, the operation of the stereo representation unit is inactivated at step S407 because the stereo coding effect is insignificant.

An algorithm of the input channel correlation analyzer may become complicated to accurately decide whether to operate the stereo representation unit. Herein, if the calculation amount of the algorithm is greater than that of the stereo representation unit, the effect of lengthening lifecycle of batteries by reducing calculation amount cannot be acquired. Therefore, the input channel correlation analyzer should adopt as simple algorithm as possible to decide whether to operate the stereo representation unit or not. The present invention may be applied to a case where there are more than two input channels.

The method of the present invention may be embodied as a program and stored in a computer-readable recording medium, such as CD-ROM, RAM, ROM, floppy disks, hard disks, magneto-optical disks and the like. Since this procedure can be easily implemented by those skilled in the art to which the present invention pertains, it will not be described herein in detail.

While the present invention has been described with respect to certain preferred embodiments, it will be apparent to those skilled in the art that various changes and modifications may be made without departing from the scope of the invention as defined in the following claims.

The invention claimed is:

1. An apparatus for coding audio signals based on signal distribution characteristics of each channel, comprising:

a down-mixer for receiving multi-channel audio signals and down-mixing the multi-channel audio signals into mono signals;

a coder for coding the mono signals;

an input channel correlation analyzer for receiving the multi-channel audio signals, deciding whether to give stereo effect to the multi-channel audio signals based on signal distribution characteristics of the multi-channel audio signals for each channel, and outputting a control signal indicating whether to perform stereo representation process; and a stereo representation unit for performing stereo representation process onto the multi-channel audio signals when the control signal indicating to perform stereo representation process, wherein the input channel correlation analyzer includes:

an auto-correlation calculator for calculating and outputting auto-correlation for the multi-channel audio signals;

a cross-correlation calculator for calculating and outputting cross-correlation for the multi-channel audio signals;

a correlation ratio calculator for receiving the auto-correlation and the cross-correlation, calculating a ratio between the auto-correlation and the cross-correlation, and outputting a correlation ratio; and a stereo coding decider for comparing the correlation ratio with a predetermined threshold and deciding whether to inactivate operation of a stereo representation unit, wherein the stereo coding decider generates and outputs a control signal including information for inactivating operation of the stereo representation unit when the correlation ratio is smaller than the threshold, and the stereo coding decider generates and outputs a control signal including information for operating the stereo representation unit when the correlation ratio is not smaller than the threshold.

2. A method for coding audio signals based on signal distribution characteristics of each channel, comprising:

receiving multi-channel audio signals;

down-mixing the multi-channel audio signals into mono signals;

coding the mono signals; and deciding whether to give stereo effect to the multi-channel audio signals based on signal distribution characteristics of each channel, wherein deciding whether to give stereo effect to the multi-channel audio signals includes:

calculating auto-correlation for the multi-channel audio signals;

calculating cross-correlation for the multi-channel audio signals;

acquiring a correlation ratio by calculating a ratio between the auto-correlation and the cross-correlation;

comparing the correlation value with a predetermined threshold; and deciding whether to perform stereo representation.

3. The method of claim 2, wherein deciding whether to give stereo effect to the multi-channel audio signals includes:

generating and outputting a control signal including information for holding the stereo representation process when the correlation ratio is smaller than the threshold; and generating and outputting a control signal including information for performing the stereo representation process when the correlation ratio is not smaller than the threshold.

4. The method of claim 3, wherein the multi-channel audio signals are stereo voice signals.

* * * * *